United States Patent [19]

Bentham

[11] 4,349,010

[45] Sep. 14, 1982

[54] FROST REMOVAL SYSTEM

[76] Inventor: Thomas J. Bentham, c/o AgWest Industries, Ltd., P.O. Box 56, Headingly, Manitoba, Canada

[21] Appl. No.: 120,322

[22] Filed: Feb. 11, 1980

[30] Foreign Application Priority Data

Nov. 14, 1979 [CA] Canada ..... 339862

[51] Int. Cl.[3] ..... F23C 5/00; E02D 3/00

[52] U.S. Cl. ..... 126/271.1; 126/271.2 R; 165/45; 405/131; 405/234; 52/741

[58] Field of Search ..... 126/271.1, 271.2 R; 404/95, 77, 79; 165/45; 405/56, 57, 131, 152, 234; 52/741

[56] References Cited

U.S. PATENT DOCUMENTS

| | | | |
|---|---|---|---|
| 1,587,984 | 6/1926 | Pearce . | |
| 1,904,001 | 4/1933 | Kimmel . | |
| 2,262,704 | 11/1941 | Tompkins et al. . | |
| 3,047,701 | 7/1962 | Früngel | 404/95 X |
| 3,105,134 | 9/1963 | Liu . | |
| 3,293,863 | 12/1966 | Cox et al. . | |
| 3,656,306 | 4/1972 | Thorpe | 405/131 |
| 3,706,824 | 12/1972 | Huber et al. | 126/271.1 X |
| 3,791,443 | 2/1974 | Burt et al. . | |
| 3,868,825 | 3/1975 | Boyce . | |
| 3,990,502 | 11/1976 | Best | 405/130 X |
| 4,006,732 | 2/1977 | Schumm | 126/271.1 |

FOREIGN PATENT DOCUMENTS

| | | |
|---|---|---|
| 253869 | 9/1925 | Canada . |
| 285444 | 12/1928 | Canada . |
| 769461 | 10/1967 | Canada . |
| 780118 | 3/1968 | Canada . |
| 953119 | 8/1974 | Canada . |
| 956471 | 10/1974 | Canada . |

*Primary Examiner*—Larry Jones

*Attorney, Agent, or Firm*—Stevens, Davis, Miller & Mosher

[57] ABSTRACT

A method for removing frost from a selected area of the ground in accordance with one aspect of the invention involves positioning a plurality of hollow pipes over the area to be thawed, each pipe having an exhaust end and an inlet end. These pipes and the immediately adjacent ground areas, save for the inlet and exhaust ends of the pipes, are then covered with a bed of sand, gravel, or like filler material to a selected depth to provide a heat insulating and heat sink effect. Following this, burning gases are directed for a selected period of time along the length of each such pipe from a plurality of burners, each burner being disposed at the inlet end of a respective one of the pipes. The heated gases are allowed to travel along the length of the pipe and to escape from their exhaust ends whereby to effect heating of and thawing of the selected ground area.

10 Claims, 7 Drawing Figures

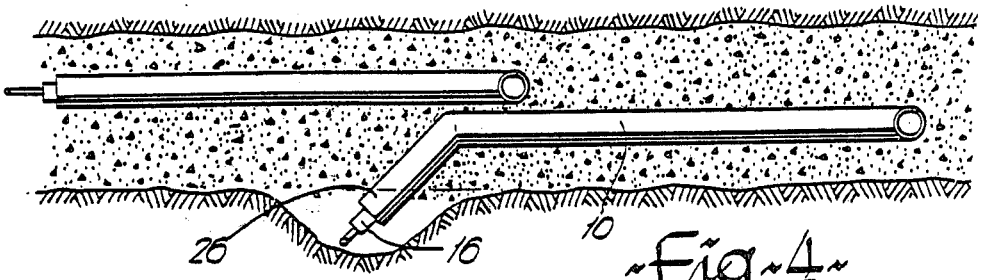
Fig. 4
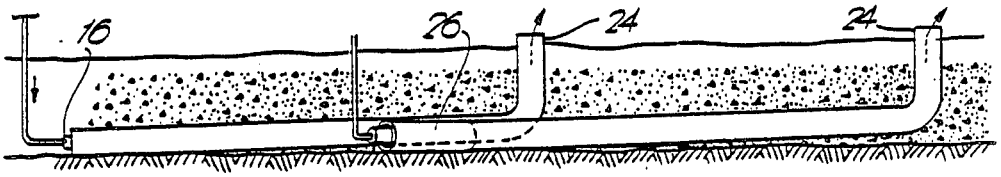
Fig. 5
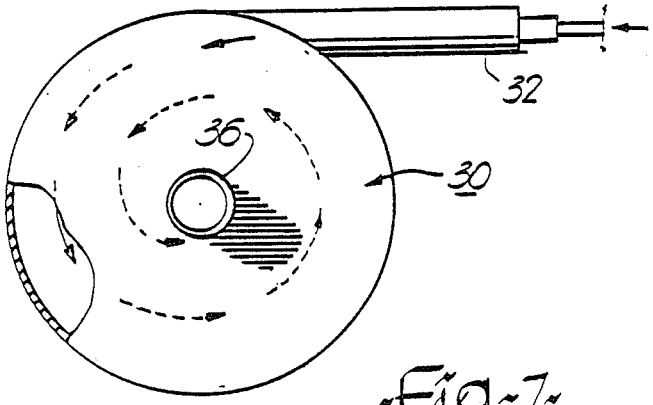
Fig. 7
Fig. 6
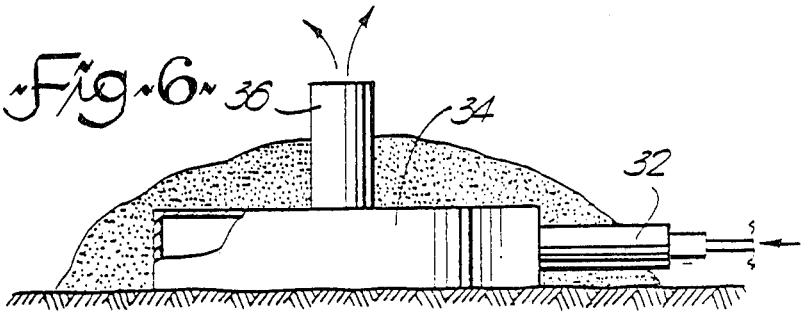

FROST REMOVAL SYSTEM

This invention relates to a method for removing frost from a selected area of the ground prior to proceeding with further construction steps.

The removal of ground frost as a preliminary step to further construction work often poses a severe problem in most parts of Canada and the northern U.S.A., as well as in many other countries throughout the world, during the winter season. Numerous techniques have been developed over the years, many of such techniques involving the drilling of holes into the earth and the injection of heated fluids in one form or another in an effort to promote thawing. Generally speaking, such systems have posed a number of difficulties both in terms of the initial cost of the equipment involved, the time for effecting thawing and in terms of ease of set-up of equipment and transportation from one work site to another.

It is an object of the prsent invention to provide improved methods for removing frost from selected areas of the ground which alleviates many of the difficulties encountered when using prior art procedures and which method or system utilizes very simple and readily available equipment and which, in addition to being relatively rapid and efficient, helps construction companies to adhere to construction schedules as by promoting the orderly scheduling of various construction crews.

A method for removing frost from a selected area of the ground in accordance with one aspect of the invention involves positioning a plurality of hollow pipes over the area to be thawed, each pipe having an exhaust end and an inlet end. These pipes and the immediately adjacent ground areas, save for the inlet and exhaust ends of the pipes, are then covered with a bed of sand, gravel, or like filler material to a selected depth to provide a heat insulating and heat sink effect. Following this, burning gases are directed for a selected period of time along the length of each such pipe from a plurality of burners, each burner being disposed at the inlet end of a respective one of the pipes. The heated gases are allowed to travel along the length of the pipe and to escape from their exhaust ends whereby to effect heating of and thawing of the selected ground area.

In a preferred form of the invention each pipe is sloped slightly upwardly from its inlet end to its exhaust end to facilitate travel of the heat from the burner along the full length of the pipe.

In one mode of operation according to the invention, the pipes are positioned over the area of the ground in a laterally spaced generally co-extensive parallel relationship. This set-up is used when relatively wide areas of ground are to be thawed as, for example, prior to the pouring of foundations for a building structure.

According to another mode of operation, the pipes are positioned over the ground in a generally serially arranged relationship thereby to effect thawing of an elongated relatively narrow area such as would be used in the excavation of a ditch or trench.

In the last mentioned mode of operation, adjacent ends of the generally serially arranged pipes are either closely adjacent to or overlap one another slightly to avoid any gaps in the frost removal pattern. The exhaust ends of the pipes are advantageously provided with upwardly directed elbows thereon to facilitate escape of exhaust gases from above the bed of material while the inlet ends preferably have laterally angled extensions thereon to facilitate burner attachment thereto while avoiding interference between the bed of material and the burners.

According to a further aspect of the invention, and regardless of the mode of operation used, after a selected period of time the burners are shut off and the pipes may be subsequently lifted up out of the heated bed of material. The bed of heated material may then be allowed to remain for a period of time thereby to protect the thawed area of ground from re-freezing. Under ordinary conditions, since the bed of heated material will protect the ground from re-freezing for quite some time, possibly two days or more, the construction company is more readily enabled to adhere to predetermined production schedules, i.e. it is not necessary for an excavation crew to remain on standby thereby to commence excavation as soon as the burners have been shut off. In addition, the pipes and burners which have been removed from the bed of material can then be transported to another work site immediately and the same procedure re-commenced.

The frost removal system or method according to the invention can be used for frost removal where foundations, floor slabs on grade, general excavations and ditching excavations and grading are a necessary phase of construction to adhere to construction schedules. With the system according to the invention, the materials used for the above-noted bed (sand or gravel with ample fine materials to act as a heat insulator and for heat retaining) can be subsequently used as bedding for piping, conduit, electrical cables and the like, for bringing up grade and slab soffit or for final compaction under footings. Thus, in effect, the only materials which need be transported from one site to another are the pipes and their associated burners, the remaining materials being usable in the subsequent construction stages. The relatively simple equipment used, i.e. the pipes and burners, can be transported easily from site to site and at seasons end stored in a relatively compact manner for use the following winter season.

A separate aspect of the invention also provides a method of removing frost from a relatively confined area of ground as, for example, where a post hole is to be formed. This aspect of the invention involves positioning a generally circular chamber over the confined area, which chamber has a tangential inlet and a generally centrally located top outlet. The chamber and the immediately adjacent ground area, save for the chamber inlet and outlet, are then covered with a bed of sand, gravel or like fill material to a selected depth to provide an insulating and heat sink effect. Then, for a selected period of time, burning gases are directed into the tangential inlet to cause the burning gases to swirl around the interior of the chamber and to escape from the top outlet whereby to effect heating and thawing of the confined area of the ground.

Preferred embodiments of the invention will now be described, reference being had to the accompanying drawings in which:

FIG. 4 is a plan view of a modified system usable in connection with ditching or trenching operations;

FIG. 5 is a side elevation view partly in section of the system according to FIG. 4;

FIG. 6 is a side elevation view of a system for removing frost from a confined area of ground for post hole digging; and FIG. 7 is a plan view of the system illustrated in FIG. 6.

Figure 1:
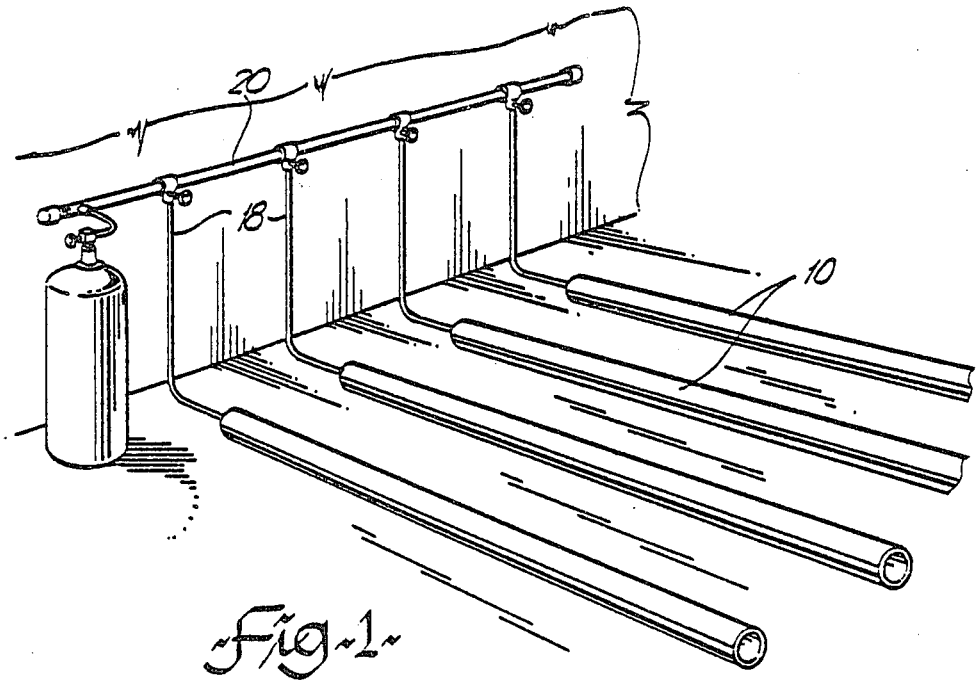
FIG. 1 is a perspective view of a system for removing frost from an area of the ground (before the pipes are covered with the bed of sand or gravel)
Figure 2:
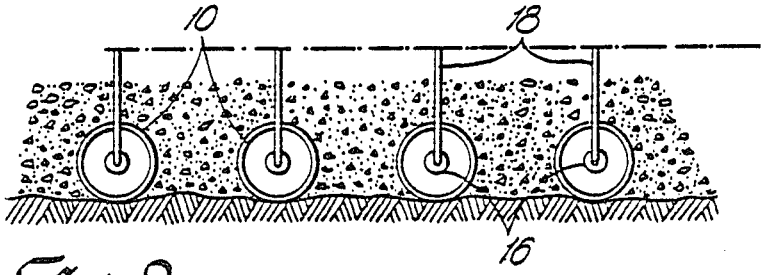
FIG. 2 is a transverse section of the system illustrated in FIG. 1 illustrating the spacing between the pipes.
Figure 3:
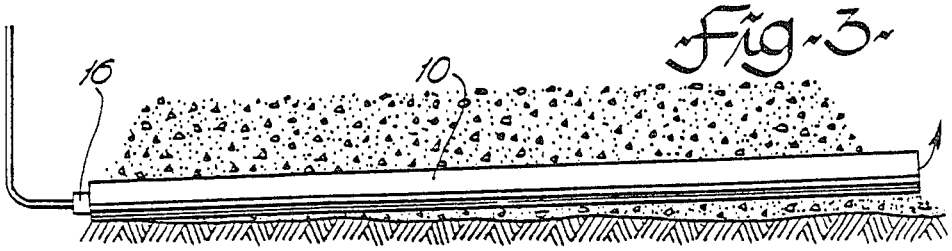
FIG. 3 is a longitudinal section view of the system of FIG. 1.

The system shown in FIGS. 1–3 is adapted for removal of frost from relatively large areas of ground as for example in an area where a floor slab is to be subsequently laid. It will be seen from the drawings that a series of pipes 10 have been positioned on the area to be thawed. In a particular example, four inch nominal diameter heavy walled steel pipe was positioned over the area to be thawed. The center to center pipe spacing was about a maximum of two feet. The exhaust ends of the pipe were positioned approximately three inches above the level position to help ensure drawing the heat the full length of the pipe. The spaced parallel lengths of pipe 10 and the immediately adjacent ground areas were then covered with a layer of sand to a depth of approximately 10 inches above the upper surfaces of the pipes. A greater thickness of sand provides a greater heat storage capacity and thus a greater thickness of sand or gravel is desirable especially if the contractor plans to retain the heat for 24 hours or longer after the burners have been shut off thereby to cope with excavation scheduling. In applying the bed of sand or gravel, care should be taken to ensure that the pipe interiors remain free of sand thereby to allow the heat to travel the full length of the pipes.

The inlet end of each pipe is provided with a suitable burner 16. For the example given above, each pipe was provided with a "Tiger" (registered trademark) torch capable of operating on propane and producing a maximum output of about 208,000 BTU's/hour (Model 95-B). Because of the high heat output of the burners, it is necessary to use a heavy walled pipe (e.g. schedule 80 or better) thereby to avoid burn-out or collapse of the pipe wall.

If an enclosed area is being defrosted, the outlet ends of the pipes 10 can be fitted with 90° elbows which, in turn, can be connected to suitable duct work thereby to carry exhaust fumes out of the enclosed area.

The burners 16 are connected via individual propane gas supply lines 18 to a suitable header 20 which, in turn, is connected to a propane tank.

In a typical operation utilizing the set-up described above, an area of ground having an area of approximately 660 square feet was thawed down to a depth of 6 feet in a 24 hour period, the burners being operated at full capacity throughout this period. The total propane consumption comprised two hundred gallons of propane during this period.

Following the 24 hour period noted above, the burner valves were shut off and the burner units were removed. Following a short cooling period, a piece of excavating machinery was moved in to the area and the pipes were lifted free of the sand bed, the hot sand bed being allowed to lie over the area thereby to keep the area warm, i.e. prevent re-freezing. It was found that the bed was still at a temperature of some 40° F. after 48 hours even though the ambient air temperature was, for most of this time, at an average temperature of something slightly below 0° F.

In the arrangement shown in FIGS. 4 and 5, pipes 10 as described above were laid out in a generally serially arranged relationship to effect thawing of an elongated relatively narrow area such as for a ditch or trench. As seen in FIG. 4, the adjacent ends of the generally serially arranged pipes overlap slightly to avoid any gaps in the frost removal pattern. The exhaust ends of the pipes are provided with upwardly directed elbows 24 thereon to facilitate escape of exhaust gases from above the bed of sand or gravel. In addition, the inlet ends of the pipes are provided with laterally angled extensions 26 thereby to facilitate attachment of the burners thereto. The pipe lengths, diameters and sloping as well as the burners used were all the same as described in connection with the first example.

If a fairly wide ditch system is to be excavated, then spaced pairs of pipes can be laid out in serially arranged relation thereby to achieve the desired width.

In one particular example, 150 linear feet of ditch system required approximately 100 gallons of propane to effect thawing down to a depth of about 6 feet. For every given situation, some amount of trial and error may be involved as, depending upon the nature of the earth being thawed, somewhat differing amounts of time and/or heat energy will be required With reference to the system shown in FIGS. 6 and 7 which is adapted for removing frost from a confined area of ground where a post hole is to be dug, there is provided a generally circular cylindrical chamber 30, such chamber having a tangential inlet 32 in its side wall and having a relatively flat top wall 34 with a centrally disposed upwardly extending exhaust outlet 36 provided therein. In operation, the above assembly is positioned over the area to be thawed and a propane burning torch, as described above, is positioned in the tangential inlet 32. The entire assembly, with the exception of the inlet 32 and exhaust outlet 36 is covered to a depth of 10 inches or more with sand or gravel for the same purposes as described previously and the burner is then turned on thus causing a swirling of the heated gases within the chamber 34 as illustrated by the arrows in FIG. 7. The swirling gases ultimately escape from the exhaust outlet 36.

In a typical example of the above arrangement, the chamber 30 had an overall diameter of about 4 feet with the inlet and exhaust pipes both being of four inch diameter. A propane burner as described previously operating at full capacity used approximately 20 gallons of propane to thaw the region beneath chamber 30 down to a depth of about 5 feet.

Since the equipment used in the method of the invention is of a relatively simple nature, it can be transported as a unit from area to area and used many times without added expense. By way of example a trailer can be equipped with 10 lengths of a four inch diameter 30 foot long steel pipe as described above along with a propane fuel tank, a vaporizer (required during low temperature for efficient fuel supply), 10 burner units and associated supply header and piping, as well as a post or pole hole frost removal unit as described in conjunction with FIGS. 6 and 7. This complete unit should suffice for most frost removal problems likely to be encountered.

Preferred embodiments of the invention have been described by way of example. Those skilled in the art will realize that various modifications may be made without departing from the spirit or scope of the invention. For definitions of the invention, reference is to be had to the claims appended hereto.

The embodiments of the invention in which an exclusive property or privilege is claimed are defined as follows:

1. A method for removing frost from a selected area of ground comprising:

(a) positioning a plurality of hollow pipes over the area to be thawed, each pipe having an inlet and an exhaust end;

(b) covering said pipes and the immediately adjacent ground areas to substantially surround said pipes, save for the inlet and exhaust ends of the pipes, with a bed of sand, gravel or equivalent fill materials to a selected depth to provide a heat insulating and heat sink effect, and (c) directing, for a selected period of time, burning gases along the lenth of each pipe from a plurality of burners each being disposed at the inlet end of a respective one of the pipes, and allowing the heated gases to travel along the lengths of the pipes and to escape from their exhaust ends whereby to effect heating of and thawing of said selected area of ground.

2. The method according to claim 1 wherein each said pipe is sloped slightly upwardly from its inlet end to its exhaust end to facilitate travel of the heat from the burner along the full length of the pipe.

3. The method according to claim 1 wherein said pipes are positioned over said area of the ground in laterally spaced generally co-extensive and parallel relationship.

4. The method according to claim 2 wherein said pipes are positioned over said area of the ground in laterally spaced generally co-extensive and parallel relationship.

5. The method according to claim 1 wherein said pipes are positioned over said area of the ground in a generally serially arranged relationship thereby to effect thawing of an elongated relatively narrow area such as for a ditch.

6. The method according to claim 2 wherein said pipes are positioned over said area of the ground in a generally serially arranged relationship thereby to effect thawing of an elongated relatively narrow area such as for a ditch.

7. The method according to claim 5 wherein adjacent ends of the generally serially arranged pipes are either closely adjacent or overlap slightly to avoid any gaps in the frost removal pattern and wherein the exhaust ends of the pipes have upwardly directed elbow means thereon to facilitate escape of exhaust gases and the inlet ends have laterally angled extensions thereon to facilitate burner attachment thereto.

8. The method according to claim 1, 2 or 3 wherein after said selected period of time, said burners are shut off and said pipes lifted up out of the heated bed of material, the bed of heated material being allowed to remain thereby to protect the thawed area of ground from re-freezing for a period of time.

9. The method according to claim 5, 6 or 7 wherein after said selected period of time, said burners are shut off and said pipes lifted up out of the heated bed of material, the bed of heated material being allowed to remain thereby to protect the thawed area of ground from re-freezing for a period of time.

10. A method of removing frost from a relatively confined area of ground as where a post hole is to be formed comprising:

(a) positioning a generally circular chamber over said area, which chamber has a tangential inlet, and a generally centrally located top outlet;

(b) covering said camber and the immediately adjacent ground area, save for the chamber inlet and outlet, with a bed of sand, gravel or like fill material to a selected depth to provide an insulating and heat sink effect, and (c) directing, for a selected period of time, buring gases into said tangential inlet whereby the burning gases swirl around the interior of the chamber and escape from the outlet whereby to effect heating and thawing of said confined area of the ground.

* * * * *